US005567211A

United States Patent [19]

Russo et al.

[11] Patent Number: 5,567,211

[45] Date of Patent: Oct. 22, 1996

[54] MOTOR FUEL DETERGENT ADDITIVES

[75] Inventors: Joseph M. Russo; Christopher S. Liu, both of Poughkeepsie, N.Y.; Thomas F. DeRosa, Passaic, N.J.; Benjamin J. Kaufman, Hopewell Junction, N.Y.; Scott O. Lindholm, Novi, Mich.; James R. Ketcham, Salt Point, N.Y.

[73] Assignee: Texaco Inc., White Plains, N.Y.

[21] Appl. No.: 507,899

[22] Filed: Aug. 3, 1995

[51] Int. Cl.[6] ..... C01L 1/22

[52] U.S. Cl. ..... 44/412; 44/418; 44/419

[58] Field of Search ..... 44/412, 418, 419

[56] References Cited

U.S. PATENT DOCUMENTS

| | | | |
|---|---|---|---|
| 3,510,282 | 5/1970 | Seffens . | |
| 4,060,553 | 11/1977 | Redmore et al. . | |
| 4,146,556 | 3/1979 | Redmore et al. . | |
| 4,427,562 | 1/1984 | Horodysky et al. . | |
| 4,518,782 | 5/1985 | Sung et al. . | |
| 4,568,358 | 2/1986 | Courtney . | |
| 4,832,702 | 5/1989 | Kummer et al. | 44/412 |
| 5,203,879 | 4/1993 | Su et al. | 44/419 |
| 5,234,478 | 8/1993 | Su et al. | 44/419 |
| 5,383,942 | 1/1995 | Su et al. | 44/418 |

*Primary Examiner*—Margaret Medley
*Attorney, Agent, or Firm*—Kenneth R. Priem; Richard A. Morgan

[57] ABSTRACT

A motor fuel additive composition comprising a mixture of an amido alkanolamine and a polyisobutylene amine is provided. A fuel composition providing intake valve and combustion chamber detergency is also provided.

18 Claims, No Drawings

MOTOR FUEL DETERGENT ADDITIVES

BACKGROUND OF THE INVENTION

1. Field of the Invention

This invention is related to gasoline engine detergents, and more particularly to gasoline intake valve deposit (IVD) inhibitor additives, i.e., agents which assist in preventing and removing deposits from intake valves and related parts of a gasoline combustion engine and to combustion chamber deposit (CCD) inhibitors.

2. Description of Related Information

The combustion of a hydrocarbon fuel in an internal combustion engine leads to the formation and accumulation of deposits on various parts of the combustion chamber as well as on the fuel intake and exhaust systems of the engine. The presence of deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs causing engine knock. In addition, the accumulation of deposits within the combustion chamber reduces the volume of the combustion zone, causing a higher than design compression ratio in the engine. This, in turn, can also lead to engine knocking. A knocking engine does not effectively utilize the energy of combustion. Moreover, a prolonged period of engine knocking can cause stress fatigue and wear in pistons, connecting rods, bearings and cam rods of the engine. The phenomenon noted is characteristic of gasoline powered internal combustion engines. It may be overcome by employing a higher octane gasoline, which resists knocking, for powering the engine. This need for a higher octane gasoline as mileage accumulates has become known as the engine octane requirement increase (ORI) phenomenon. It is particularly advantageous if engine ORI can be substantially reduced or eliminated by preventing or modifying deposit formation in the combustion chambers of the engine.

Another problem common to internal combustion engines is the formation of intake valve deposits. Intake valve deposits interfere with valve closing and eventually result in poor fuel economy. Such deposits interfere with valve motion and valve sealing, cause valve sticking, and, in addition, reduce volumetric efficiency of the engine and limit maximum power. Valve deposits are produced from the combustion of thermally and oxidatively unstable fuel or lubricating oil oxidation products. The hard carbonaceous deposits produced collect in the tubes and runners that are part of the exhaust gas recirculation (EGR) flow. These deposits are believed to be formed from exhaust particles which are subjected to rapid cooling while mixing with the air-fuel mixture. Reduced EGR flow can result in engine knock and in increased $NO_x$ emissions. It would therefore be desirable to provide a motor fuel composition which minimizes or overcomes the formation of intake valve deposits and subsequent valve sticking problems.

Both of the aforementioned problems have been addressed in the art. However, more effective and less costly solutions are always sought. An additional problem is introduced when both problems are attempted to be solved simultaneously. Frequently, an additive which reduces deposits in one area, will increase deposits in the other. For example, polyisobutylene amine (PIBA) based detergents provide intake valve deposit inhibition, but typically contribute to combustion chamber deposit buildup.

Co-assigned U.S. Pat. No. 5,234,478 describes a class of amido alkanolamines, obtained by reacting 4-alkyl-2-morpholinone with an alkylphenoxypolyoxyalkylene amine. These amido alkanolamines have potent combustion chamber and intake valve deposit inhibiting properties.

U.S. Pat. No. 4,832,702 describes a class of PIBA which provide intake valve deposit inhibiting properties. PIBA based detergents typically contribute to combustion chamber deposits, thereby limiting their usefulness.

An object of this invention is to provide a novel additive composition which may be employed in fuel compositions and particularly in a motor fuel composition.

Another object is to provide a fuel additive composition and a motor fuel composition which inhibits the formation of intake valve deposits in an internal combustion engine without contributing to CCD.

Another object of this invention is to provide a fuel additive and a fuel composition which inhibits or reduces the formation of combustion chamber deposits in an internal combustion engine.

Yet another object of this invention is to provide a concentrate composition which may be added to a motor fuel to provide motor fuel compositions of the instant invention.

SUMMARY OF THE INVENTION

A gasoline additive comprising a mixture of a) an amido alkanolamine, comprising the condensation product of 4-alkyl-2-morpholinone represented by the formula:

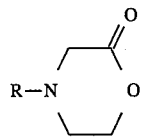

in which R represents a monovalent aliphatic radical having from 1 to 10 carbon atoms, and an alkylphenoxypolyoxyalkylene amine represented by the formula:

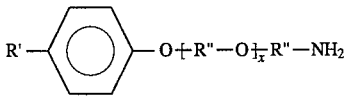

in which R' is a saturated hydrocarbyl radical having from about 4 to 30 carbon atoms, x represents a number from about 4 to 50, and R" represents a saturated $C_2$–$C_4$ hydrocarbyl radical or any combination of $C_2$–$C_4$ hydrocarbyl radicals, such that the polyoxyalkylene radical can comprise any combination of repeating $C_2$–$C_4$ oxyalkylene units to form block or random copolymers; and b) a polyisobutylene amine having a molecular weight less than about 5000 and a low polydispersity.

DETAILED DESCRIPTION OF THE INVENTION

We have discovered an additive composition which provides superior intake valve and combustion chamber detergency. The additive composition is a combination of polyisobutylene amine (PIBA) and the condensation product of 4-alkyl-2-morpholinone and alkylphenoxypolyoxyalkylene amine.

The amido alkanolamine condensation product of a 4-alkyl-2-morpholinone and an alkylphenoxypolyoxyalkylene amine is a known combustion chamber and intake valve detergent, and is described in co-assigned U.S. Pat. Nos. 5,234,478 and 5,383,942 which are incorporated herein by reference.

The class of 4-alkyl-2-morpholinones used to prepare the reaction product additive of the instant invention may be represented by the formula:

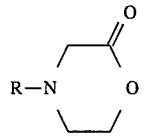

in which R represents a monovalent aliphatic radical having from 1 to 10 carbon atoms. Preferably, R is an alkyl radical having from 1 to 4 carbon atoms and most preferably having from 1 to 3 carbon atoms. Specific compounds within the scope of the formula include 4-methyl-2-morpholinone, 4-ethyl-2-morpholinone, and 4-isopropyl-2-morpholinone. 4-methyl-2-morpholinone is particularly preferred.

The alkylphenoxypolyoxyalkylene amine reactant is represented by the formula:

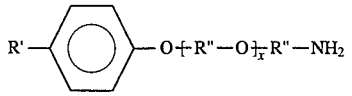

in which R' is a saturated hydrocarbyl radical having from about 4 to 30 carbon atoms, x represents a number from about 4 to 50, and R" represents a saturated $C_2$–$C_4$ hydrocarbyl radical or any combination of $C_2$–$C_4$ hydrocarbyl radicals, such that the polyoxyalkylene radical can comprise any combination of repeating $C_2$–$C_4$ oxyalkylene units to form block or random copolymers. For example, R" can comprise a mixture of $C_2$ and $C_3$ hydrocarbyl radicals, a mixture of $C_2$ and $C_4$ hydrocarbyl radicals, a mixture of $C_3$ and $C_4$ hydrocarbyl radicals or a mixture of $C_2$–$C_4$ hydrocarbyl radicals. Preferably R" represents a mixture of $C_3$ and $C_4$ hydrocarbyl radicals. Preferably, R' represents a monovalent aliphatic radical having from about 6 to 24 carbon atoms, and more preferably an aliphatic radical having from about 8 to 20 carbon atoms. A particularly preferred value for R' is from 9 to 18 carbon atoms. A preferred value for x is from about 6 to 30, with the most preferred value being from about 10 to 20.

The 4-alkyl-2-morpholinone reactant and the alkylphenoxypolyoxyalkylene amine reactant are reacted in about a 1:1 mole ratio to provide an amido alkanolamine. Hereinafter, when we use the term amido alkanolamine we are referring to the reaction product of 4-alkyl-2-morpholinone and alkylphenoxypolyoxyalkylene amine as defined herein. While other mole ratios are contemplated, no significant advantage is realized in departing from about equimolar reaction ratios.

The amido alkanolamine component of the invention may be represented by the formula:

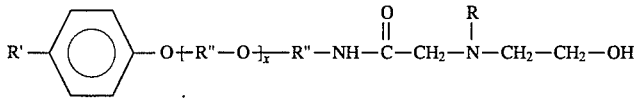

in which R, R', R" and x have the values defined above.

The PIBA component of the additive composition of the invention is represented by the formula R-$NH_2$, where R is a saturated hydrocarbyl radical, and which is characterized as having a molecular weight less than about 5000, preferably 500 to about 1500, and more preferably about 900 to about 1100, with a low polydispersity.

The additive composition of this invention comprises the combination of the two components, the amido-alkanolamine compound and the PIBA. Typically, the two components are combined in a ratio of between about 2:1 to about 10:1 (amido-alkanolamine to PIBA), preferably in a ratio of about 5:1 to about 7:1 and more preferably in a ratio of about 6:1.

We were surprised by the results of combining PIBA and amido-alkanolamine. Typically, PIBA's, and other high molecular weight alkyl amines, tend to contribute to CCD. We have discovered that PIBA does not contribute to CCD when combined with amido alkanolamine. In fact, we found that CCD was reduced by the combination of amido alkanolamine and PIBA as compared to alkylphenoxypolyoxyalkylene amine alone. In a further surprising result, we have discovered a critical ratio of amido alkanolamine and PIBA which provides superior intake valve deposit results.

We have determined that a ratio of 75 parts by weight (pbw) of an amido alkanolamine and 12.5 pbw PIBA provides deliver optimum IVD control. Tables I and II provide summaries of the effectiveness of the two component fuel additive in varying ratios using the GM 2.0 L and 3.1 L Keep Clean Engine Tests.

GM 2.0 L Engine Test

The GM 2.0 L engine test is used to measure a fuel's or a fuel additive's effect on intake system deposits and combustion chamber deposits. This test makes use of a 1983 model year, General Motors, 2.0 liter, 4 cylinder, throttle body injected, push rod engine mounted on a dynamometer stand. The test runs for 192 continuous hours as it repeats the two step test cycle shown below.

| Stage # | Speed (RPM) | Load (ft*lbs) | Time (minutes) |
|---|---|---|---|
| 1 | 1200 | 10.0 | 6 |
| 2 | 2500 | 35.0 | 12 |

At the beginning of the test, the engine is cleaned to remove all fuel related deposits and assembled using a cylinder head that has been rebuilt to the manufacturers specifications. The intake valves are weighed before being assembled in the cylinder head. At the end of the test the intake valve deposits are quantified by weighing the deposit formation. Combustion chamber deposit thickness is measured in mils using an eddy current/magnetic induction thickness measuring device (Fischer Permascope).

The GM 3.1 L Engine Test

The GM 3.1 L engine test is used to measure a fuel's or a fuel additive's effect on intake valve deposits and combustion chamber deposits. This test makes use of a 1991 model year, General Motors, 3.1 liter, V shaped, 6 cylinder, port fuel injected, push rod engine mounted on a dynamometer stand. The test runs for 192 continuous hours as it repeats the three step test cycle shown below.

| Stage # | Speed (RPM) | Load (ft*lbs) | Time (minutes) |
|---|---|---|---|
| 1 | 600 | 0.0 | 0.5 |
| 2 | 1400 | 25.0 | 6 |
| 3 | 2500 | 37.0 | 12 |

At the beginning of the test, the engine is cleaned to remove all fuel related deposits and assembled using cylinder heads that has been rebuilt to the manufacturers specifications. The intake valves are weighed before being assembled in the cylinder heads. At the end of the test the intake valve deposits are quantified by weighing the deposit formation. Combustion chamber deposit thickness measuring device (Fischer Permascope).

TABLE I

Results of GM 2.0L Keep Clean Engine Test

| Ratio of amido alkanolamine to PIBA | amido alkanolamine (PTB) | PIBA (PTB) | Intake Valve Deposits (mg) | Combustion Chamber Deposit Thickness (mil) |
|---|---|---|---|---|
| 2:1 | 50 | 25 | 336.1 | 12.36 |
| 6.66:1 | 100 | 15 | 160.4 | 9.64 |
| 10:1 | 75 | 7.5 | 237.2 | 12.0 |
| 6:1 | 75 | 12.5 | 98.3 | 8.43 |

TABLE II

Results of GM 3.1L Keep Clean Engine Test

| Ratio of amido alkanolamine to PIBA | amido alkanolamine (PTB) | PIBA (PTB) | Intake Valve Deposits (mg) | Combustion Chamber Deposit Thickness (mil) |
|---|---|---|---|---|
| — | 100 | 0 | 494.2 | 10.08 |
| 2:1 | 50 | 25 | 693.4 | 9.14 |
| 10:1 | 75 | 7.5 | 417.0 | 9.83 |
| 6:1 | 75 | 12.5 | 81.5 | 9.11 |

These data indicate that while the combination of amido alkanolamine and PIBA at all ratios is an effective intake valve and combustion chamber detergent, there is a critical ratio of amido alkanolamine to PIBA, namely 6:1, at which dramatic intake valve deposit detergency and superior combustion chamber detergency is exhibited.

THE MOTOR FUEL COMPOSITION

The motor fuel composition of the present invention comprises a major portion of a hydrocarbon fuel boiling in the gasoline range between 90° F. and about 370° F., and a minor portion of the additive composition of the present invention sufficient to reduce the formation of intake valve and combustion chamber deposits.

Preferred base motor fuel compositions are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 370° F. This base fuel may consist of straight chain or branched chain paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. In addition, the motor fuel composition may contain any of the additives generally employed in gasoline. Thus, the fuel composition can contain anti-knock compounds such as tetraethyl lead compounds, anti-icing additives, and the like.

The additive composition is typically added to motor fuel at a treat rate of about 25 to about 2000 PTB, preferably about 40 PTB to about 1000 PTB and more preferably about 50 PTB to about 300 PTB.

The additive of the present invention is effective in very small concentrations and, therefore, for consumer end use it is desirable to package it in dilute form. Thus, a dilute form of the additive composition of the present invention can be provided comprising a diluent e.g., xylene and about 1 to about 50 wt. % of the additive.

We claim:

1. A motor fuel additive comprising a mixture of a) an amido alkanolamine, comprising the condensation product of 4-alkyl-2-morpholinone represented by the formula:

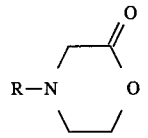

in which R represents a monovalent aliphatic radical having from 1 to 10 carbon atoms, and an alkylphenoxypolyoxyalkylene amine represented by the formula:

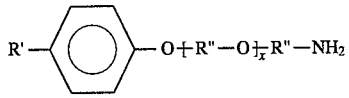

in which R' is a saturated hydrocarbyl radical having from about 4 to 30 carbon atoms, x represents a number from about 4 to 50, and R" represents a saturated $C_2$–$C_4$ hydrocarbyl radical or any combination of $C_2$–$C_4$ hydrocarbyl radicals, such that the polyoxyalkylene radical can comprise any combination of repeating $C_2$–$C_4$ oxyalkylene units to form block or random copolymers; and b) a polyisobutylene amine having a molecular weight less than about 5000 and a low polydispersity; and wherein the amido alkanolamine and the polyisobutylene amine are present in a weight ratio of between about 2:1 to about 10:1.

2. The motor fuel additive of claim 1 wherein the amido alkanolamine and the polyisobutylene amine are present in a weight ratio of between about 5:1 to about 7:1.

3. The motor fuel additive of claim 1 wherein the amido alkanolamine and the polyisobutylene amine are present in a weight ratio of about 6:1.

4. The motor fuel additive of claim 1 wherein R" is a $C_3$ hydrocarbyl radical.

5. The motor fuel additive of claim 1 wherein R" represents a mixture of $C_3$ and $C_4$ hydrocarbyl radicals.

6. The motor fuel additive of claim 1 wherein x is a number between about 10 and about 20.

7. The motor fuel additive of claim 1 wherein R is a $C_1$–$C_4$ hydrocarbyl radical.

8. The motor fuel additive of claim 1 wherein the polyisobutylene amine has a molecular weight between about 500 and about 1500.

9. The motor fuel additive of claim 1 wherein the polyisobutylene amine has a molecular weight between about 900 and about 1100.

10. A motor fuel composition comprising a major portion of a hydrocarbon fuel boiling in the gasoline range between 90° F. and about 370° F., and a minor portion, sufficient to reduce the formation of intake valve and combustion chamber deposits, upon combustion of the motor fuel composition in an internal combustion engine, of an additive composition comprising a mixture of a) an amido alkanolamine, comprising the condensation product of 4-alkyl-2-morpholinone represented by the formula:

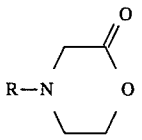

in which R represents a monovalent aliphatic radical having from 1 to 10 carbon atoms, and an alkylphenoxypolyoxyalkylene amine represented by the formula:

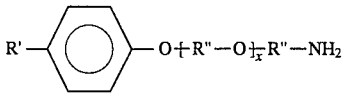

in which R' is a saturated hydrocarbyl radical having from about 4 to 30 carbon atoms, x represents a number from about 4 to 50, and R" represents a saturated $C_2$–$C_4$ hydrocarbyl radical or any combination of $C_2$–$C_4$ hydrocarbyl radicals, such that the polyoxyalkylene radical can comprise any combination of repeating $C_2$–$C_4$ oxyalkylene units to form block or random copolymers; and b) a polyisobutylene amine having a molecular weight less than about 5000 and a low polydispersity; and wherein the amido alkanolamine and the polyisobutylene amine are present in a weight ratio of between about 2:1 to about 10:1.

11. The motor fuel composition of claim 10 wherein the amido alkanolamine and the polyisobutylene amine are present in a weight ratio of between about 5:1 to about 7:1.

12. The motor fuel composition of claim 10 wherein the amido alkanolamine and the polyisobutylene amine are present in a weight ratio of about 6:1.

13. The motor fuel composition of claim 10 wherein R" is a $C_3$ hydrocarbyl radical.

14. The motor fuel composition of claim 10 wherein R" represents a mixture of $C_3$ and $C_4$ hydrocarbyl radicals.

15. The motor fuel composition of claim 10 wherein x is a number between about 10 and about 20.

16. The motor fuel composition of claim 10 wherein R is a $C_1$–$C_4$ hydrocarbyl radical.

17. The motor fuel composition of claim 10 wherein the polyisobutylene amine has a molecular weight between about 500 and about 1500.

18. The motor fuel composition of claim 10 wherein the polyisobutylene amine has a molecular weight between about 900 and about 1100.

* * * * *